United States Patent [19]

Wilson et al.

[11] Patent Number: 4,968,915

[45] Date of Patent: Nov. 6, 1990

[54] MAGNETIC FIELD GENERATING ASSEMBLY

[75] Inventors: Martin N. Wilson, Abingdon; Marcel J. M. Kruip, Oxford, both of England

[73] Assignee: Oxford Instruments Limited, Oxford, England

[21] Appl. No.: 366,355

[22] Filed: Jun. 15, 1989

Related U.S. Application Data

[63] Continuation of Ser. No. 144,499, Jan. 15, 1988, abandoned.

[30] Foreign Application Priority Data

Jan. 22, 1987 [GB] United Kingdom ..... 8701363

[51] Int. Cl.[5] ..... H01J 1/50; H05H 13/00; H01F 7/06

[52] U.S. Cl. ..... 313/62; 313/154; 328/234; 335/214; 335/301

[58] Field of Search ..... 328/234; 313/62, 154; 335/214, 301; 315/8

[56] References Cited

U.S. PATENT DOCUMENTS

| | | | |
|---|---|---|---|
| 4,580,120 | 4/1986 | Jacquot | 335/214 X |
| 4,587,504 | 5/1986 | Brown et al. | 335/301 X |
| 4,612,505 | 9/1986 | Zijlstra | 335/214 X |
| 4,641,104 | 2/1987 | Blosser et al. | 328/234 |

FOREIGN PATENT DOCUMENTS

| | | | |
|---|---|---|---|
| 8607229 | 12/1986 | PCT Int'l Appl. | 328/234 |

*Primary Examiner*—Palmer C. DeMeo
*Attorney, Agent, or Firm*—Brumbaugh, Graves, Donohue & Raymond

[57] ABSTRACT

A cyclotron includes a magnetic field generating assembly defined by a pair of main, superconducting coils mounted about the axis of the cyclotron on a former. The coils are surrounded by an ion shield positioned within a cryostat. Radially outwardly of the shield are positioned a pair of coils which guide most or all of the magnetic flux due to the coils leaking out of the shield back into the shield.

12 Claims, 10 Drawing Sheets

MAGNETIC FIELD GENERATING ASSEMBLY

This application is a continuation of application Ser. No. 144,499, filed on 1/15/88, and now abandoned.

FIELD OF THE INVENTION

The invention relates to magnetic field generating assemblies and in particular those assemblies used in cyclotrons, magnetic resonance imagers and other applications where large magnetic fields are generated.

DESCRIPTION OF THE PRIOR ART

We have recently developed a new cyclotron which is described in our copending International Patent Application No. PCT/GB86/00284. This cyclotron includes a magnetic field generator formed from superconducting coils housed in a cryostat. The field generated in the cyclotron has a mean value of 2.5 T and a peak field considerably in excess of this. In the field of magnetic resonance imaging, relatively large bore fields are also generated. In both cases, the generation of large internal fields is accompanied by the generation of relatively large external or fringe fields outside the main apparatus and extending through a relatively large radius. Up to now, these fringe fields have been shielded by siting the apparatus within a large external iron shield. These shields are very bulky, costly, and heavy and considerably restrict the areas where the apparatus can be sited and are generally undesirable when the cyclotron or imager is to be used in the medical field.

One of the major problems with these shields is that iron has a non-linear saturation property. Thus, although at low fields (and low magnetic flux densities) a given iron shield acts as a good "conduit" for magnetic flux (ie. there is no flux leakage from the shield), at high flux densities the iron fails to contain all the flux. This is because the iron starts to saturate. At present, the only solution to this problem is to increase the amount of iron used.

SUMMARY OF THE INVENTION

In accordance with the present invention, we provide a magnetic field generating assembly comprising first magnetic field generating means for generating a first magnetic field; a ferro-magnetic shield positioned about the first magnetic field generating means; and second magnetic field generating means for guiding magnetic flux of the first magnetic field leaking out of the shield back into into the shield.

We have devised a much simpler form of shield which requires far less ferro-magnetic material for a given magnetic field than previously proposed shields and is thus much lighter and less costly but which can effectively shield the high strength magnetic fields commonly generated in cyclotrons and the like. This improvement has been achieved by providing the second magnetic field generating means to guide most or all of the magnetic flux of the first magnetic field leaking out of the shield back into the shield. This enables optimum usage of the shield to be achieved and thus the size of the shield can be reduced to a minimum.

Typically, the first magnetic field generating means is tubular, and, in most cases, the first magnetic field generating means will have a circular cross-section and be cylindrical. For example, the first magnetic field generating means may be provided by one or more cylindrical, electrical coils.

The shield which is conveniently made of iron, is preferably tubular with the first magnetic field generating means being positioned within the shield.

The shield is preferably continuous but could be segmented in the radial plane and the axial plane.

Preferably, the shield has inwardly projecting flanges at each end. These flanges assist in maximising the flux which is guided into the shield.

The second magnetic field generating means may, like the first magnetic field generating means, be provided by one or more permanent magnets but is conveniently defined by at least one electrical coil. This latter arrangement has the advantage that the strength of the magnetic field generated by this coil can be varied to obtain optimum conditions.

The second magnetic field generating means may be positioned at least partly outwardly of the shield and/or at each end of the shield.

Preferably, the second magnetic field generating means comprises one or more electrical coils mounted closely to the shield. In this way, the or each coil is in the form of a thin current sheet and provides a "flux wall" to contain the flux within the shield.

In some examples, one or both of the first and second magnetic field generating means may be provided by resistive electrical coils but typically the first magnetic field generating means comprises a superconducting magnet defined by one or more coils positioned within a cryostat. In these examples, although the shield could be positioned outside the cryostat, it is preferably provided within the cryostat, most preferably in the same temperature region as the coils of the first magnetic field generating means. This latter arrangement reduces the overall bulk of the assembly. Also, with this latter arrangement the second magnetic field generating means may also comprise at least one superconducting coil positioned within the cryostat, preferably within the same temperature region as the first magnetic field generating means.

Where the first and second magnetic field generating means comprise electrical coils, these coils are preferably connected in series so that changes in currents applied to the first magnetic field generating means are duplicated in the second magnetic field generating means automatically and so compensating fields are automatically produced at the correct strength.

One important application of the invention is in the field of cyclotrons.

BRIEF DESCRIPTION OF THE DRAWINGS

An example of a superconducting cyclotron incorporating a magnetic field generating assembly according to the invention will now be described with reference to the accompanying drawings, in which.

DETAILED DESCRIPTION OF AN EMBODIMENT

Figure 1:
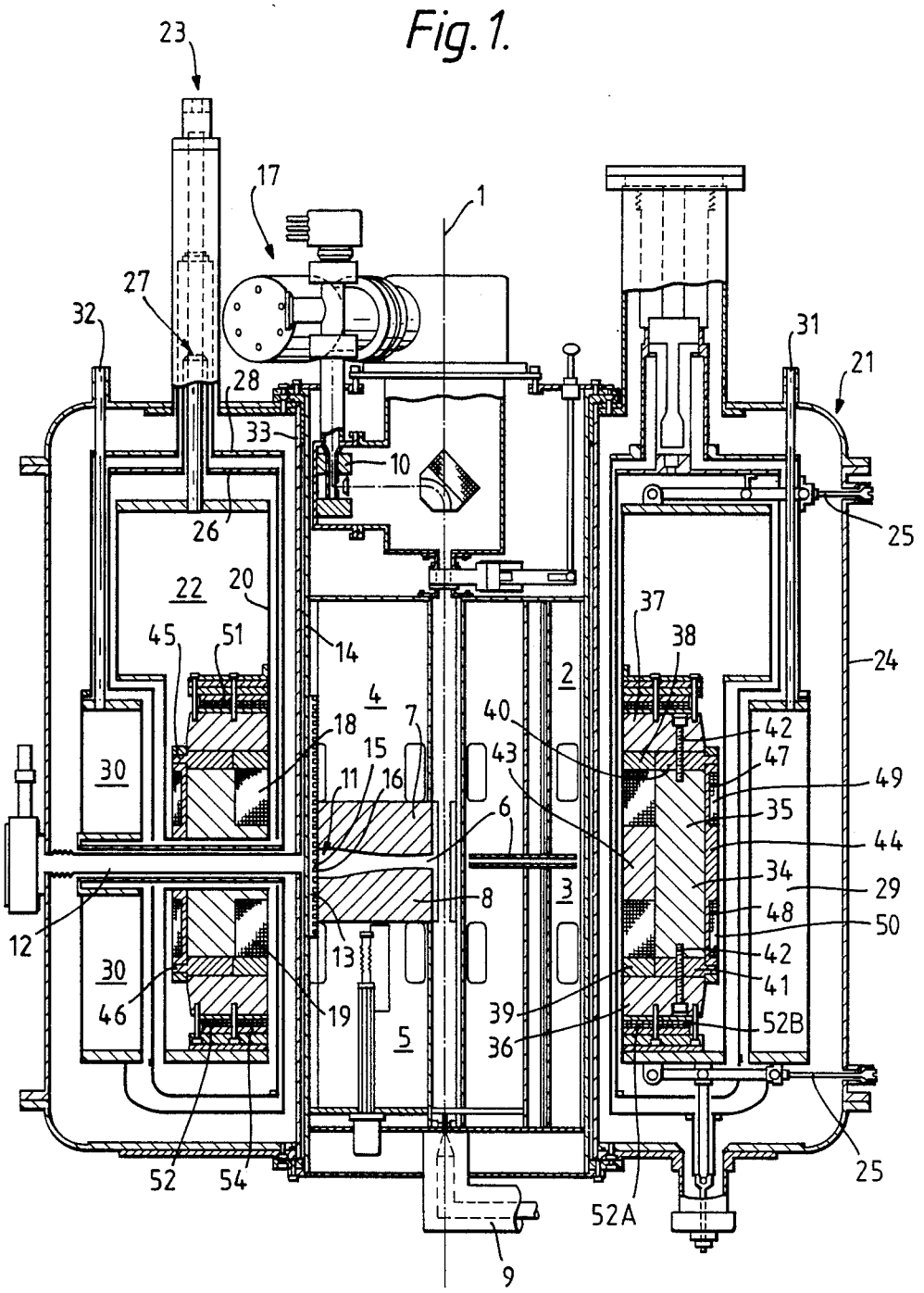
FIG. 1 is a cross-section through the cyclotron.

The cyclotron shown in cross-section in FIG. 1 has a construction very similar to that illustrated in our International Patent Application No. PCT/GB86/00284. The cyclotron has three dees defined by respective, axially aligned pairs of sector-shaped members substantially equally circumferentially spaced around an axis 1 of the cyclotron and positioned within an evacuated chamber. Two pairs of the sector-shaped members 2, 3; 4. 5 are shown in FIG. 1. These dees provide radio frequency energisation to a beam of charged particles orbiting in a beam space 6 defined at the centre of the cyclotron between respective pairs of the sector-shaped members. Interleaved between each pair of dees are provided opposed pole pieces two of which 7, 8 are shown in FIG. 1. The pole pieces are designed and selected so as to provide the required variations in magnetic field strength in an axial magnetic field generated within the cyclotron by means to be described below.

Radiofrequency energisation is fed via three coaxial cables one of which is indicated at 9 into the cavities defined by the dees so as to produce a large oscillating voltage between the axially opposed ends of each dee cavity adjacent the beam space 6.

An ion source is provided at 10 which generates a stream of negatively charged ions which are guided along the axis 1 of the cyclotron between the dees and into the beam space 6. The existence of the axial magnetic field causes the ions to move in a curved path within the beam space 6 so that they continually cross the gaps defined between adjacent dees. Since three dees are provided, six gaps are defined. As the ions cross each gap, they are accelerated by the radiofrequency field and consequently increase in energy. This increase in energy causes the radius of the ion path to increase so that the ions describe a spiral path.

A beam outlet aperture 11 is provided in the beam space 6 aligned with a delivery pipe 12 passing out of the cyclotron. Positioned across the outlet 11 is a holder 13 slidably mounted in a slideway 14. The holder 13 has a number of radially inwardly facing legs 15 between each pair of which is mounted a thin carbon foil 16.

Once the negative ions have sufficient energy their radius will coincide with the carbon foil 16 positioned within the outlet aperture 11 so that they will strike the foil 16. This foil 16 strips negative charge from the ions, thereby converting them to positive ions. As such they are deflected by the axial magnetic field in a radially outward direction and pass out of the delivery pipe 12.

Although each carbon foil 16 has a limited life, it can easily be replaced without the necessity of gaining access to the interior of the cyclotron by simply sliding the holder 13 along the slideway 14 to bring the next foil 16 into the outlet aperture 11. The movement and position of the holder 13 can be controlled externally of the cyclotron by means not shown.

The region through which the beam passes is evacuated in a conventional manner via an evacuating module shown diagrammatically at 17.

The axial magnetic field is generated by a pair of main, superconducting coils 18, 19. Each coil 18, 19 is mounted coaxially with the axis 1 of the cyclotron on a former 20. Typically, these coils will produce a magnetic field within the cyclotron of about 3 T. In one example, each of the main coils 18, 19 have +681 k Amp-turns and a current density of 130 Amp/mm$^2$.

The main coils 18, 19 need to be superconducting in order to generate the large field required, and in order to achieve superconduction, it is necessary to reduce the temperature of the coils to that of liquid helium. This is achieved by placing the coils 18, 19 within a cryostat 21.

The cryostat 21 comprises an inner helium vessel 22, the radially inner wall of which is defined by the former 20. Helium is supplied through an inlet port 23 in a conventional manner. The helium vessel 22 is supported by an outer wall 24 of the cyclotron via radially extending supports 25 made from low heat conduction material such as glass fibre. Two of the supports 25 are shown in FIG. 1. The helium vessel 22 is suspended within a gas cooled shield 26 with the space between the shield and the vessel defining a vacuum. The shield 26 is cooled by boiling helium via the connection 27.

Around the gas cooled shield 26 is mounted another shield 28 cooled by liquid nitrogen contained within reservoirs 29, 30. These reservoirs are supplied with liquid nitrogen via inlet ports 31, 32. The nitrogen cooled shield 28 is mounted within a vacuum defined by the outer wall 24 of the cryostat and an inner wall 33.

Figure 2:
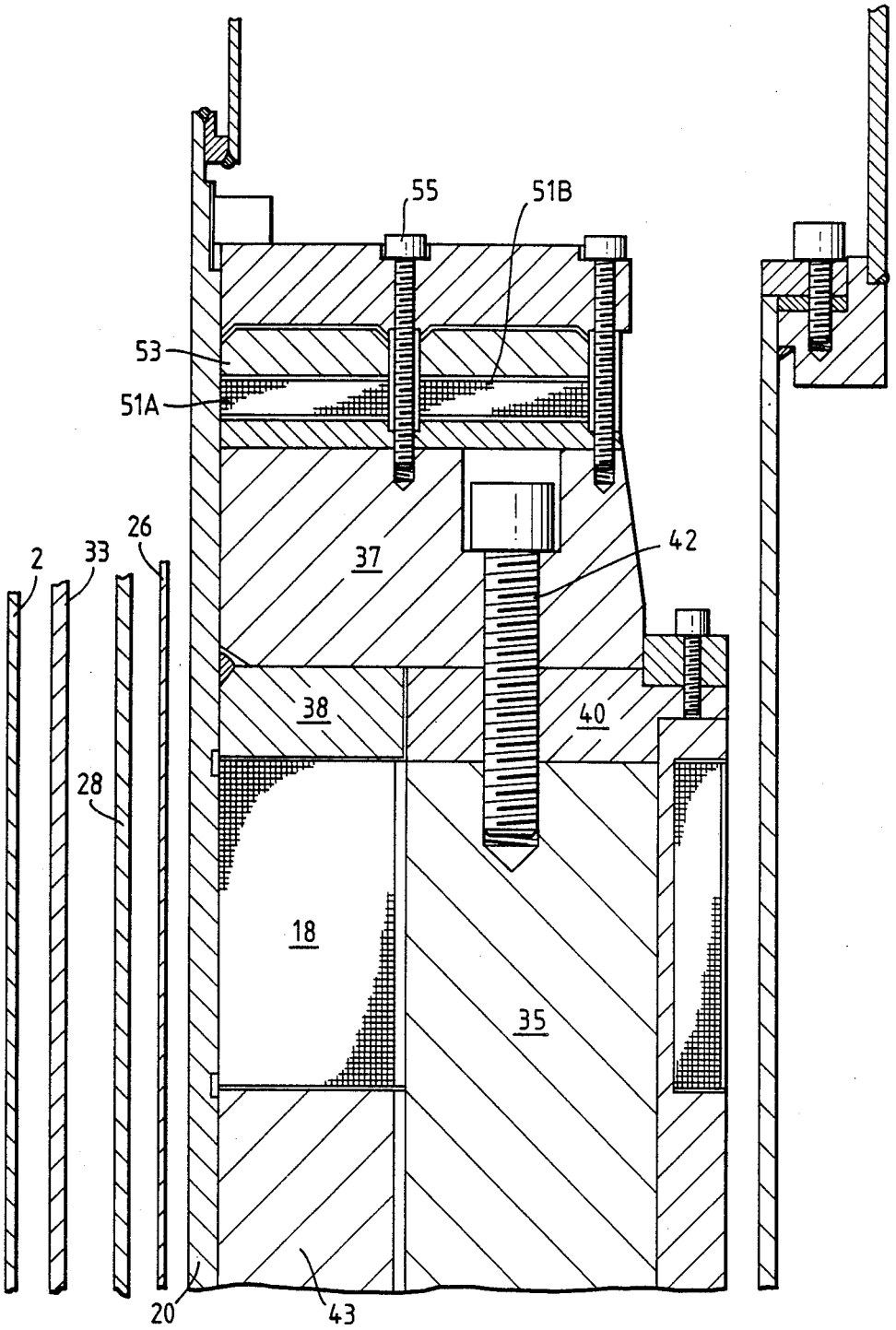
FIG. 2 is an enlarged portion of FIG. 1.

As well as producing a high strength magnetic field within the cyclotron, the main coils 18, 19 also generate a large fringe field. To shield this fringe field, a mild steel shield 34 having a generally cylindrical form is mounted within the helium vessel 22 around the main coils 18, 19. The shield 34 has a cylindrical section 35 connected with radially inwardly extending flanges 36, 37. The shield 34 is mounted to the former 20 via two mild steel annuli 38, 39 welded to the former 20. This can be seen in more detail in FIG. 2.

The cylindrical portion 35 of the shield 34 is connected with the flanges 36, 37 via a pair of annular spacers of mild steel 40, 41 and a set of circumferentially spaced bolts 42 two of which are shown in FIG. 1.

The main coils 18, 19 are secured axially by the mild steel annuli 38, 39 and a central stainless steel spacer 43.

An aluminium former 44 of cylindrical form is mounted on the radially outer surface of the shield 34. The former 44 is constrained against axial movement by a pair of flanges 45, 46 integrally formed with the spacers 40, 41. The former 44 defines a pair of axially spaced grooves 47, 48 aligned with the main coils 18, 19 and within which are positioned a pair of thin auxiliary coils 49, 50.

The auxiliary coils 49, 50 are electrically connected in series with the main coils 18, 19 and define a similar current density of 130 Amps/mm$^2$. These coils 49, 50 are wound so as to generate a secondary magnetic field which increases the flux in the shield 34.

In addition to the auxiliary coils 49, 50, two further sets of auxiliary coils 51, 52 are mounted at opposite axial ends of the shield 34. These auxiliary coils 51, 52 each comprise an inner coil 51A, 52A and an outer coil 51B, 52B each coaxial with the axis 1 of the cyclotron. The coils 51, 52 are secured in position by annular stainless steel members 53, 54 and bolts 55. In this particular example, the disc shaped coils 51, 52 again define a current density of 130 Amps/mm$^2$, and generate a magnetic field to increase the flux in the shield 34. In the example shown in FIG. 2 where the main coils have +681 k Amp-turns each, the coils 49, 50 have −177 k Amp-turns each, and the coils 51, 52 each have about −143 k Amp-turns.

Figure 3A:
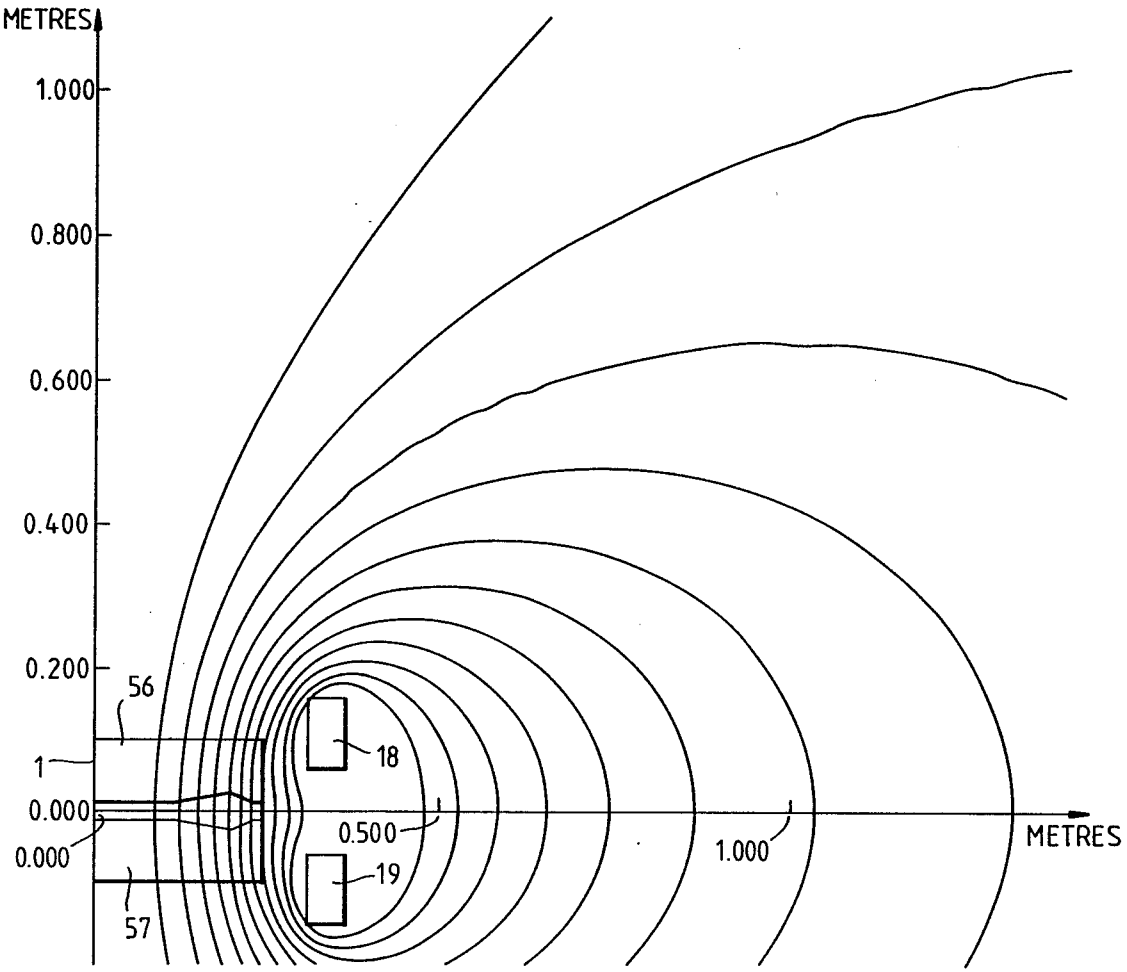
FIG. 3A illustrates the flux lines due to the main coils of the cyclotron when there is no shielding.

The affect of the shield 34 and auxiliary coils 49, 50, 51, 52 will now be explained with reference to FIGS. 3–6. FIG. 3A illustrates the lines of magnetic flux due to the main coils 18, 19 when both the shield 34 and auxiliary coils 49–52 have been omitted. FIG. 3A also illustrates two of the pole pieces 56, 57 which are circumferentially spaced from the pole pieces 7, 8. As can be seen in FIG. 3A, the lines of magnetic flux extend outwardly to distances of 2 meters and beyond.

Figure 3B:
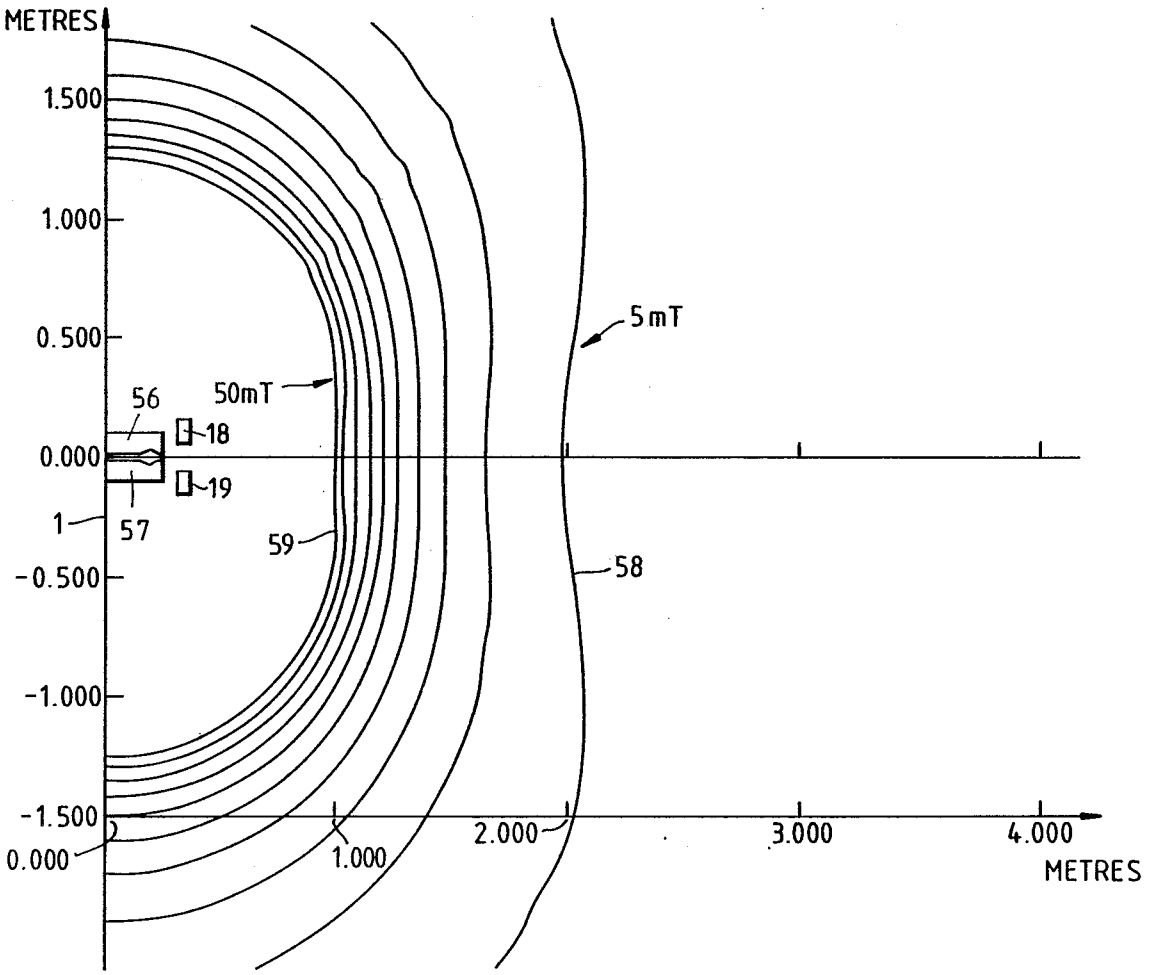
FIG. 3B illustrates the variation in magnetic field due to the main coils when there is no shielding.

FIG. 3B illustrates the same situation as FIG. 3A but in terms of lines of constant magnetic field. In this case a magnetic field of 5 mT is indicated by a line 58 while a field of 50 mT is indicated by a line 59. It will be seen that the field has a magnitude of 50 mT at about 1 meter from the axis 1 of the cyclotron and still has a significantly large magnetic field of 5 mT at 2 meters from the axis.

Figure 4A:
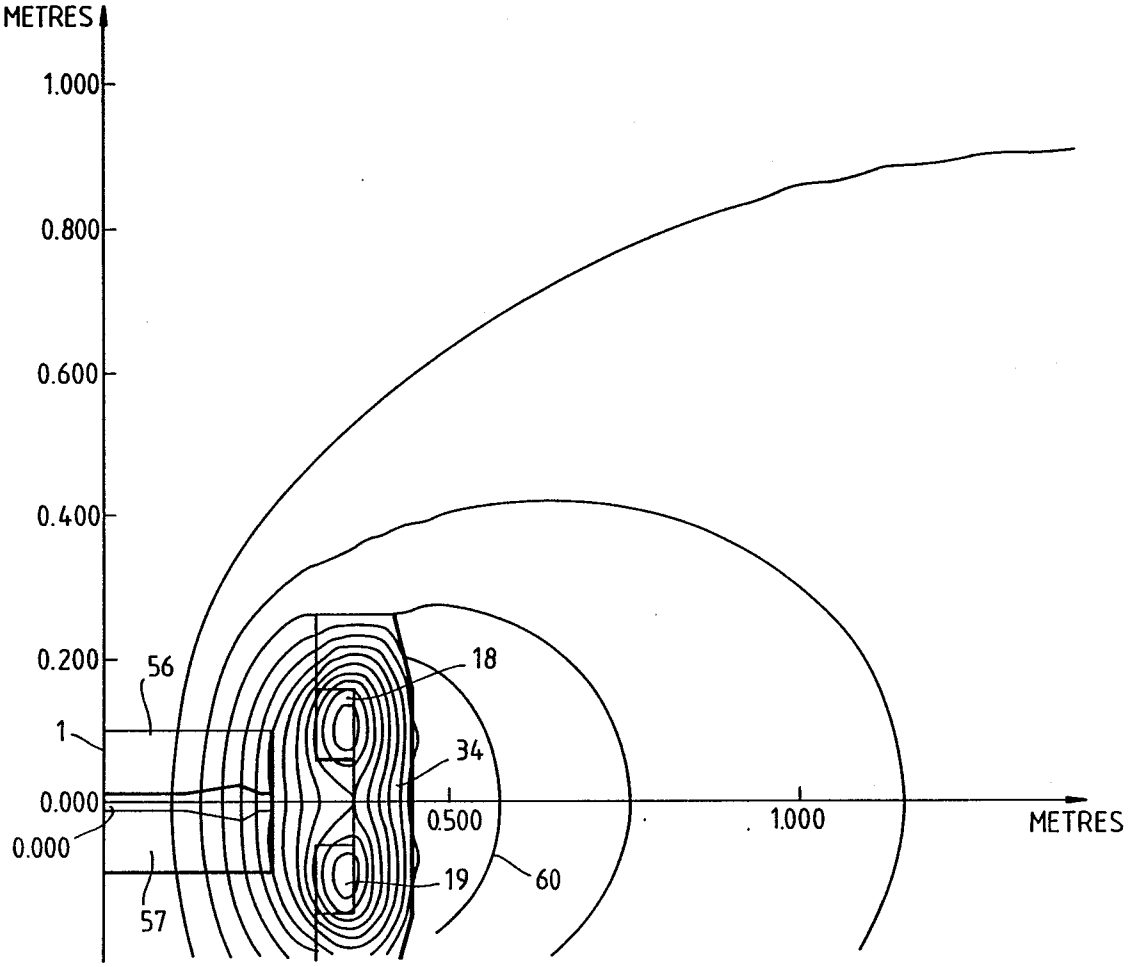
FIG. 4A and 4B are similar to FIGS. 3A and 3B but illustrate the effect of the iron shielding ring in the absence of auxiliary coils.
Figure 4B:
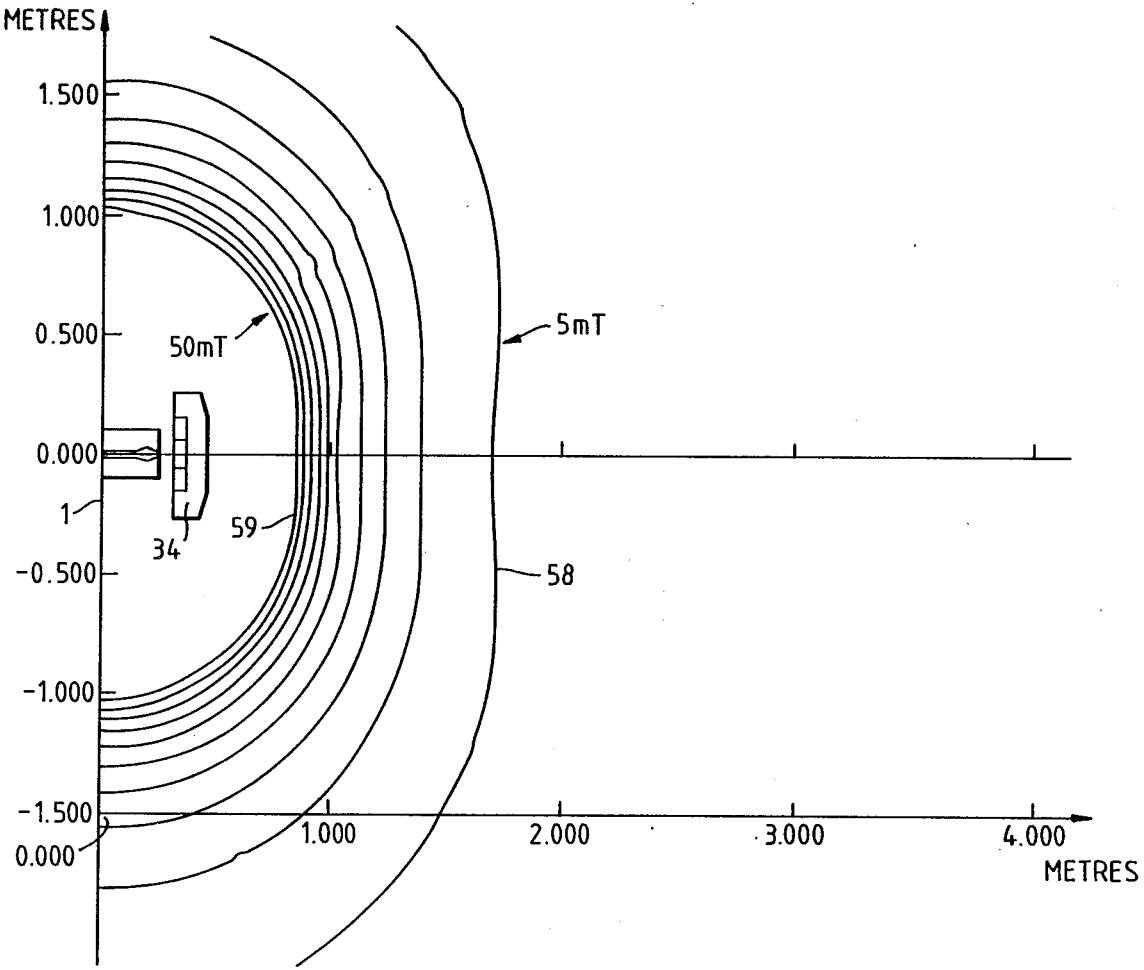

FIG. 4A illustrates the effect on the magnetic flux lines of positioning the shield 34 around the main coils 18, 19. As can be seen in FIG. 4A, there is a significant concentration of magnetic flux lines within the shield 34. However, due to the large fields involved, the shield is close to saturation and so there is a significant leakage of flux lines, for example flux line 60 from the shield 34. This leakage has the effect of producing a significant magnetic field of 5 mT at about 1.5 m from the axis 1 of the cyclotron as can be seen by the line 58 in FIG. 4B. The line 59 in FIG. 4B illustrates a field of 50 mT. This degree of shielding is not satisfactory for most purposes.

Figure 5A:
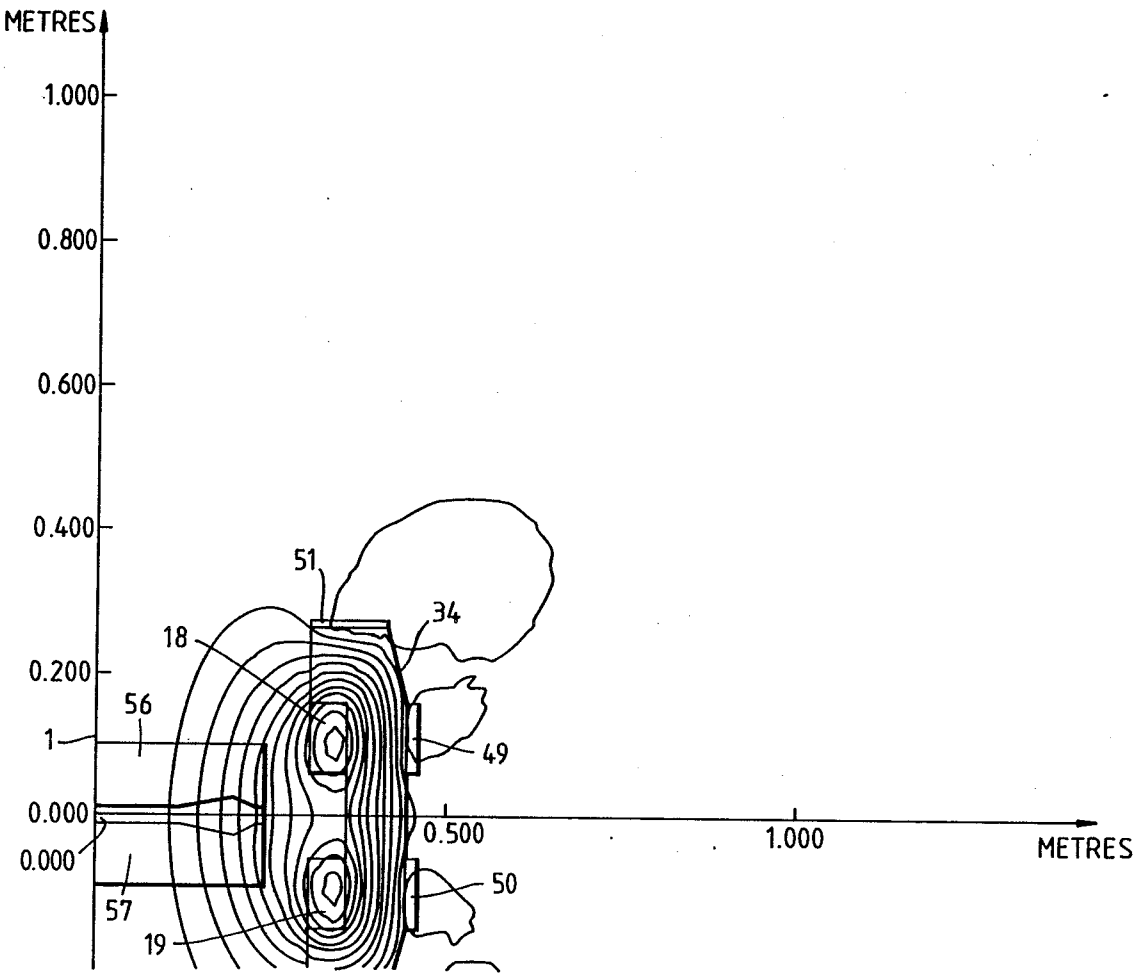
FIGS. 5A and 5B are similar to FIGS. 3A and 3B but show the effect of both an iron shield and auxiliary coils; and, FIGS. 6A and 6B are similar to FIGS. 3A and 3B but illustrate the effect of the auxiliary coils in the absence of the iron shield.
Figure 5B:
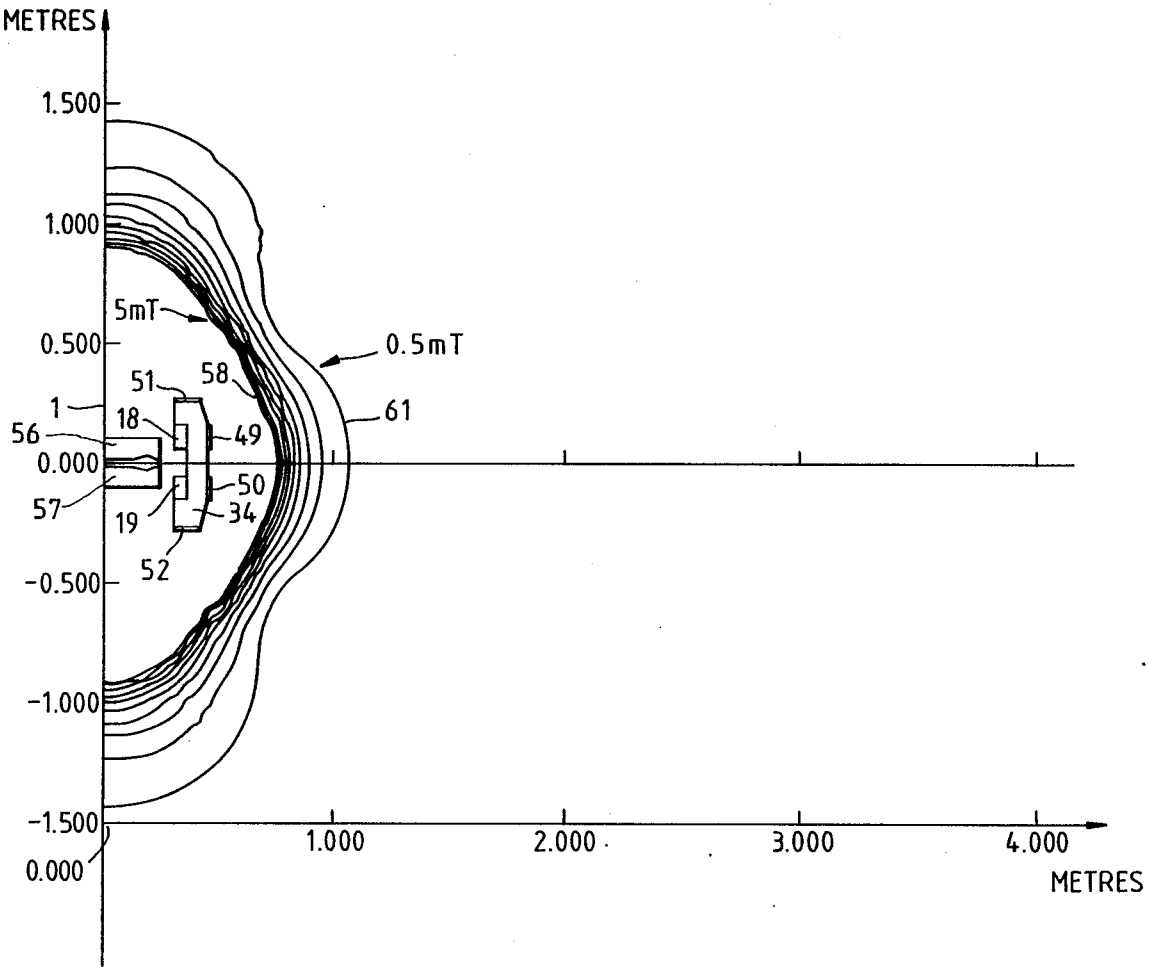

To improve the effect of the shield 34, the auxiliary coils 49–52 are provided. The effect of these coils in combination with the shield 34 is illustrated in FIG. 5A which shows that the auxiliary coils push or guide the leaking flux lines back into the shield 34. The effect of this on the external magnetic field can be seen in FIG. 5B where the 5 mT line 58 is positioned between 0.5 and 1 meter from the axis 1 while the 0.5 mT line 61 is positioned at about 1 meter from the axis. It will be seen therefore that this combination of shield 34 and auxiliary coils 49, 52 reduces very significantly the fringe magnetic field due to the main coils 18, 19.

Figure 6A:
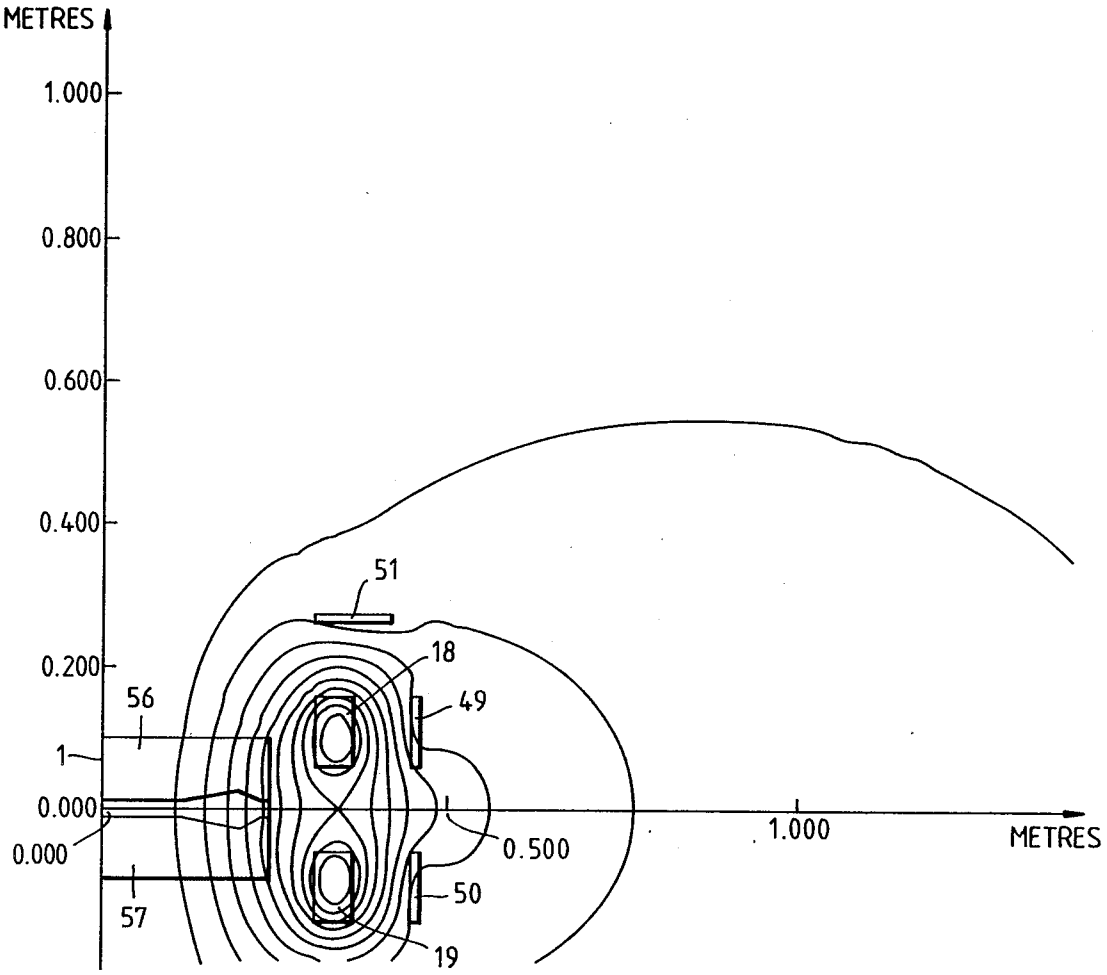
Figure 6B:
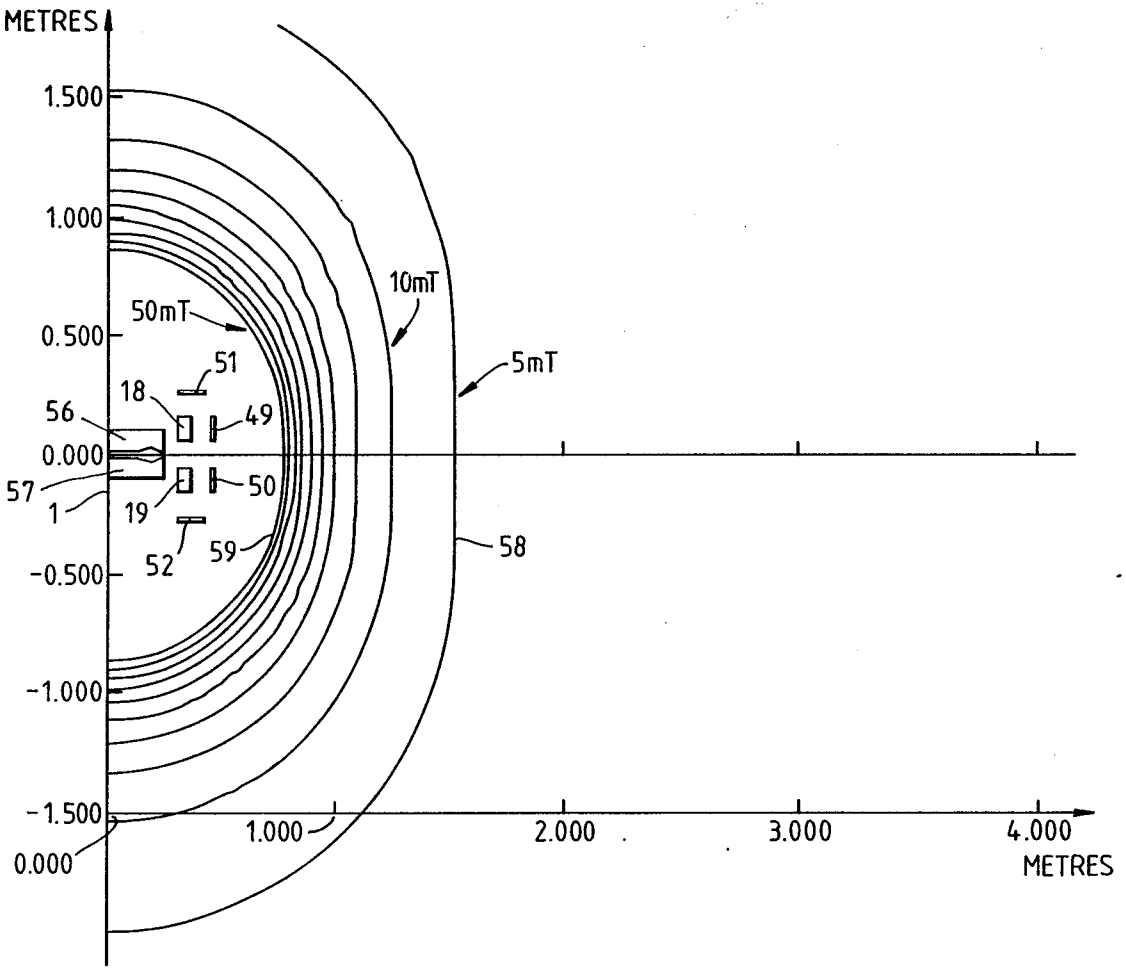

For comparison, in order to see the effect of the auxiliary coils in the absence of the shield 34, reference should be made to FIG. 6A which illustrates the flux lines in this situation and FIG. 6B which illustrates the magnitude of the magnetic field. As can be seen, the 5 mT line 58 is at about 1.5 meters from the axis 1 showing that the coils by themselves have little shielding effect.

We claim:

1. An assembly for generating a magnetic field within a volume, said assembly including a hollow substantially tubular ferro-magnetic shield with axial ends, a first magnetic field generating means, and second magnetic field generating means, said volume being defined by the ferro-magnetic material of the shield and the hollow space within the shield, said first magnetic field generating means positioned within said ferro-magnetic shield and positioned and adapted to generate substantially all of said magnetic field within said volume, said second magnetic field generating means comprising a first set of auxiliary coils mounted around and along said shield and connected in series with said first magnetic field generating means and a second set of auxiliary coils mounted at opposite axial ends of the shield, said second magnetic field generating means positioned substantially about and along said tubular shield and further positioned and adapted so as to guide magnetic flux of said magnetic field leaking from said volume back into said volume so as to optimize the quantity of flux from said first magnetic field generating means which is guided through said shield.

2. An assembly according to claim 1, said first magnetic field generating means comprises at least one cylindrical, electrical coil.

3. An assembly according to claim 1, wherein said shield is an iron shield.

4. An assembly according to claim 1, wherein said shield is tubular, said first magnetic field generating means being positioned within said shield

5. An assembly according to claim 4 wherein said shield has inwardly projecting flanges at each end.

6. An assembly according to claim 1, wherein said second magnetic field generating means comprises at least one electrical coil.

7. An assembly according to claim 6, wherein said second magnetic field generating means comprises at least one electrical coil mounted closely to said shield.

8. An assembly according to claim 1, further comprising a cryostat, and wherein said first magnetic field generating means comprises a superconducting magnet defined by at least one coil positioned within said cryostat.

9. An assembly according to claim 8, wherein said shield is positioned within said cryostat.

10. A cyclotron comprising an evacuated chamber; radio frequency energy generation means for generating radio frequency energy in the evacuated chamber; and an assembly for generating a magnetic field within a volume, said assembly including a hollow substantially tubular ferro-magnetic shield with axial ends, a first magnetic field generating means, and second magnetic field generating means, said volume being defined by the ferro-magnetic material of the shield and the hollow space within the shield and including said evacuated chamber, said first magnetic field generating means positioned within said ferro-magnetic shield and positioned and adapted to generate substantially all of said magnetic field within said volume, said second magnetic field generating means comprising a first set of auxiliary coils mounted around and along said shield and connected in series with said first magnetic field generating means and a second set of auxiliary coils mounted at opposite axial ends of the shield, said second magnetic field generating means positioned substantially about and along said tubular shield and further positioned and adapted so as to guide magnetic flux of said magnetic field leaking from said volume back into said volume so as to optimize the quantity of flux from said first magnetic field generating means which is guided through said shield, said first magnetic field generating means being further positioned and adapted so as to generate a magnetic field which guides ions within said chamber, said radio frequency energy generation means generating radio frequency energy so as to accelerate said ions guided by said magnetic field generations assembly.

11. A cyclotron according to claim 10, said cyclotron having an ion beam outlet passing radially through said magnetic field generating assembly, and further comprising a slidably mounted holder adapted to be moved across said ion beam outlet so as to bring a selected foil of a plurality of foils mounted to said holder into alignment with said ion beam, said foils being adapted to convert the polarity of said ions causing them to be ejected from said cyclotron.

12. An assembly for generating a magnetic field within a volume, said assembly including a hollow substantially tubular ferro-magnetic shield with axial ends, a first magnetic field generating means, and second magnetic field generating means, said volume being defined by the ferro-magnetic material of the shield and the hollow space within the shield, said first magnetic field generating means positioned within said ferro-magnetic shield and positioned and adapted to generate a magnetic field within said volume, said second magnetic field generating means comprising a first set of auxiliary coils mounted around and along said shield and connected in series with said first magnetic field generating means and a second set of auxiliary coils mounted at opposite axial ends of the shield, said second magnetic field generating means positioned substantially about and along said tubular shield and further positioned and adapted so as to guide magnetic flux of said magnetic field leaking from said volume back into said volume so as to optimize the quantity of flux from said first magnetic field generating mean which is guided through said shield.

* * * * *